US009022880B2

(12) United States Patent
Kawaguchi et al.

(10) Patent No.: US 9,022,880 B2
(45) Date of Patent: May 5, 2015

(54) GOLF CLUBS AND GOLF CLUB HEADS

(75) Inventors: Hiroshi Kawaguchi, Fort Worth, TX (US); Chris Savage, Fort Worth, TX (US)

(73) Assignee: Nike, Inc., Beaverton, OR (US)

( * ) Notice: Subject to any disclaimer, the term of this patent is extended or adjusted under 35 U.S.C. 154(b) by 431 days.

(21) Appl. No.: 13/105,561

(22) Filed: May 11, 2011

(65) Prior Publication Data

US 2011/0281665 A1 Nov. 17, 2011

Related U.S. Application Data

(60) Provisional application No. 61/333,602, filed on May 11, 2010.

(51) Int. Cl.
*A63B 53/00* (2006.01)
*A63B 53/04* (2006.01)

(52) U.S. Cl.
CPC ..... *A63B 53/047* (2013.01); *A63B 2053/0458* (2013.01); *A63B 2053/0425* (2013.01)

(58) Field of Classification Search
USPC ..... 473/342, 331, 332, 350, 329
See application file for complete search history.

(56) References Cited

U.S. PATENT DOCUMENTS

| | | | | |
|---|---|---|---|---|
| 4,398,965 | A | 8/1983 | Campau | |
| 4,667,963 | A | 5/1987 | Yoneyama | |
| 5,054,784 | A * | 10/1991 | Collins | 473/327 |
| 5,403,007 | A * | 4/1995 | Chen | 473/342 |
| 5,423,535 | A * | 6/1995 | Shaw et al. | 473/291 |
| 5,749,794 | A | 5/1998 | Kobayashi et al. | |
| 5,766,094 | A * | 6/1998 | Mahaffey et al. | 473/342 |
| 5,772,527 | A * | 6/1998 | Liu | 473/324 |
| 5,779,560 | A * | 7/1998 | Buck et al. | 473/342 |
| 5,827,131 | A * | 10/1998 | Mahaffey et al. | 473/342 |
| 5,967,903 | A * | 10/1999 | Cheng | 473/342 |
| 6,083,117 | A * | 7/2000 | Hsu | 473/332 |
| 6,183,381 | B1 * | 2/2001 | Grant et al. | 473/342 |
| 6,200,228 | B1 | 3/2001 | Takeda | |
| 6,227,986 | B1 * | 5/2001 | Fisher | 473/342 |
| 6,443,857 | B1 * | 9/2002 | Chuang | 473/332 |
| 6,491,593 | B2 * | 12/2002 | Takeda | 473/342 |
| 6,638,179 | B2 * | 10/2003 | Yoshida | 473/324 |
| 7,025,694 | B2 * | 4/2006 | Huang | 473/342 |
| 7,794,333 | B2 * | 9/2010 | Wallans et al. | 473/331 |
| 7,942,757 | B2 * | 5/2011 | Blumenkrantz et al. | 473/331 |
| 2003/0157995 | A1 * | 8/2003 | Mahaffey | 473/342 |
| 2004/0038746 | A1 * | 2/2004 | Wahl et al. | 473/340 |
| 2005/0009623 | A1 * | 1/2005 | Dickinson | 473/329 |
| 2005/0009630 | A1 * | 1/2005 | Chao et al. | 473/342 |

(Continued)

OTHER PUBLICATIONS

International Search Report and Written Opinion issued on Sep. 9, 2011 in corresponding International Application No. PCT/US2011/036092.

*Primary Examiner* — Melba Bumgarner
*Assistant Examiner* — Matthew B Stanczak
(74) *Attorney, Agent, or Firm* — Banner & Witcoff, Ltd.

(57) ABSTRACT

A golf club head which may include an iron-type golf club head body, a face plate, and a filler positioned behind the ball striking face. According to aspects of the disclosure, the face plate may include score lines which define holes in the face plate. Further, according to aspects of the disclosure, the filler may be comprised of a material that readily absorbs the deflection of the face plate during impact with a golf ball during a golf swing and dampens the impact between the golf club head and the golf ball.

22 Claims, 13 Drawing Sheets

(56) References Cited

U.S. PATENT DOCUMENTS

| | | | | |
|---|---|---|---|---|
| 2005/0020378 | A1* | 1/2005 | Krumme et al. | 473/332 |
| 2005/0064954 | A1* | 3/2005 | Chen et al. | 473/342 |
| 2005/0075191 | A1* | 4/2005 | Bennett | 473/342 |
| 2005/0107183 | A1* | 5/2005 | Takeda et al. | 473/326 |
| 2007/0049403 | A1* | 3/2007 | Chen | 473/342 |
| 2008/0026866 | A1 | 1/2008 | Gilbert et al. | |
| 2008/0096687 | A1* | 4/2008 | Chen | 473/342 |
| 2008/0207351 | A1 | 8/2008 | Wallans et al. | |
| 2008/0293511 | A1* | 11/2008 | Gilbert | 473/331 |
| 2009/0005191 | A1* | 1/2009 | Lin | 473/331 |
| 2009/0029796 | A1* | 1/2009 | Mergy et al. | 473/331 |
| 2009/0275421 | A1 | 11/2009 | Gilbert et al. | |
| 2009/0291774 | A1 | 11/2009 | Bennett | |
| 2010/0087269 | A1 | 4/2010 | Snyder et al. | |

* cited by examiner

GOLF CLUBS AND GOLF CLUB HEADS

RELATED APPLICATION DATA

This application is a continuation-in-part application of, and claims the benefit of, U.S. Provisional Application No. 61/333,602, filed May 11, 2010, entitled "Golf Clubs and Golf Club Heads", the disclosure of which is hereby incorporated by reference.

FIELD OF THE DISCLOSURE

The present disclosure relates to golf clubs and golf club heads. Particular example aspects of this disclosure relate to iron-type golf clubs and iron-type golf club heads.

BACKGROUND

Golf is enjoyed by a wide variety of players—players of different genders and dramatically different ages and/or skill levels. Golf is somewhat unique in the sporting world in that such diverse collections of players can play together in golf events, even in direct competition with one another (e.g., using handicapped scoring, different tee boxes, in team formats, etc.), and still enjoy the golf outing or competition. These factors, together with the increased availability of golf programming on television (e.g., golf tournaments, golf news, golf history, and/or other golf programming) and the rise of well known golf superstars, at least in part, have increased golf's popularity in recent years, both in the United States and across the world.

Golfers at all skill levels seek to improve their performance, lower their golf scores, and reach that next performance "level." Manufacturers of all types of golf equipment have responded to these demands, and in recent years, the industry has witnessed dramatic changes and improvements in golf equipment. For example, a wide range of different golf ball models now are available, with balls designed to complement specific swing speeds and/or other player characteristics or preferences, e.g., with some balls designed to fly farther and/or straighter; some designed to provide higher or flatter trajectories; some designed to provide more spin, control, and/or feel (particularly around the greens); some designed for faster or slower swing speeds; etc. A host of swing and/or teaching aids also are available on the market that promise to help lower one's golf scores.

Being the sole instrument that sets a golf ball in motion during play, golf clubs also have been the subject of much technological research and advancement in recent years. For example, the market has seen dramatic changes and improvements in putter designs, golf club head designs, shafts, and grips in recent years. Additionally, other technological advancements have been made in an effort to better match the various elements and/or characteristics of the golf club and characteristics of a golf ball to a particular user's swing features or characteristics (e.g., club fitting technology, ball launch angle measurement technology, ball spin rates, etc.).

While the industry has witnessed dramatic changes and improvements to golf equipment in recent years, there is room in the art for further advances in golf club technology.

SUMMARY OF THE DISCLOSURE

The following presents a general summary of aspects of the disclosure in order to provide a basic understanding of the disclosure and various aspects of it. This summary is not intended to limit the scope of the disclosure in any way, but it simply provides a general overview and context for the more detailed description that follows.

Golf club heads according to at least some example aspects of this disclosure include: an iron-type golf club head including an iron-type golf club head body, a ball striking face, or face plate, and a filler positioned behind the ball striking face. According to aspects of the disclosure, the face plate may include score lines which define holes in the face plate. Further, according to aspects of the disclosure, the filler may be comprised of a material that readily absorbs the deflection of the face plate during impact with a golf ball during a golf swing and dampens the impact between the golf club head and the golf ball.

Additional aspects of this disclosure relate to golf club structures that include golf club heads, e.g., of the types described above. Such golf club structures further may include one or more of: a shaft member attached to the club head (optionally via a separate hosel member or a hosel member provided as an integral part of one or more of the club head or shaft); a grip or handle member attached to the shaft member; additional weight members; etc.

Still additional aspects of this disclosure relate to methods for producing golf club heads and golf club structures, e.g., of the types described above. Such methods may include, for example: (a) providing a golf club head of the various types described above, e.g., by manufacturing or otherwise constructing the golf club head body, by obtaining the golf club head body from another source, etc.; and (b) engaging a shaft member with the golf club head. Other steps also may be included in these methods, such as engaging a grip member with the shaft member, club head body finishing steps, etc.

BRIEF DESCRIPTION OF THE DRAWINGS

The present disclosure is illustrated by way of example and not limited in the accompanying figures, in which like reference numerals indicate similar elements throughout, and in which.

Figure 1A:
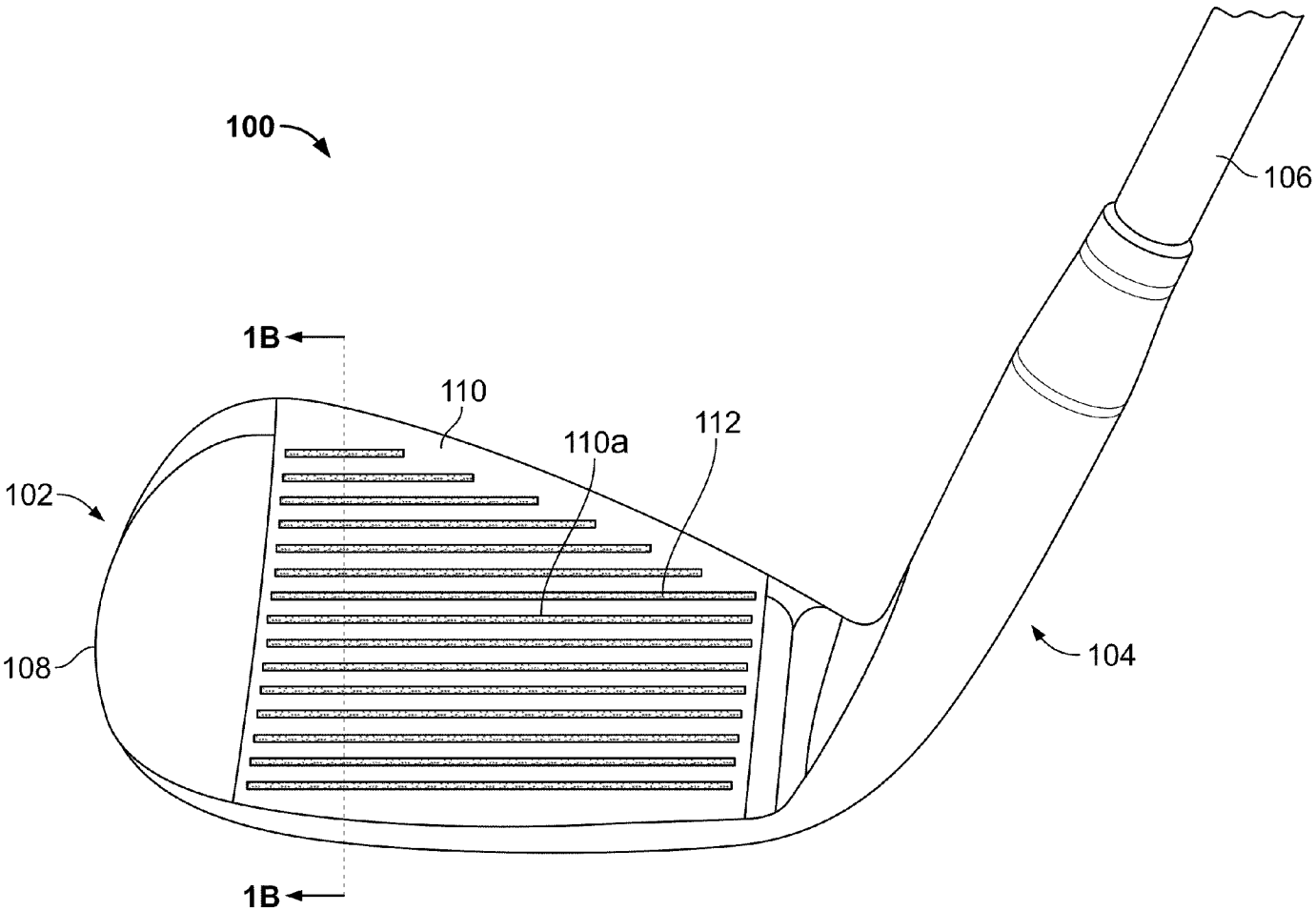
FIG. 1A is an illustrative embodiment of a golf club structure according to aspects of the disclosure.

The reader is advised that the various parts shown in these drawings are not necessarily drawn to scale.

DETAILED DESCRIPTION

The following description and the accompanying figures disclose features of golf club heads and golf clubs in accordance with examples of the present disclosure.

I. GENERAL DESCRIPTION OF EXAMPLE GOLF CLUB HEADS, GOLF CLUBS, AND METHODS IN ACCORDANCE WITH THIS DISCLOSURE

As described above, aspects of this disclosure relate to iron-type golf club heads and golf clubs. Iron-type golf club heads according to at least some example aspects of this disclosure may include: (a) an iron-type golf club head body; (b) a ball striking face, or face plate; and (c) a filler positioned behind the face plate. Further, iron-type golf club heads according to aspects of the disclosure may also include (d) a barrier member which extends between the face plate and the filler.

According to aspects of this disclosure, the face plate of the iron-type golf club head may exhibit a relatively high degree of flexibility. For example, according to aspects of the disclosure, the face plate may include score lines which define holes in the face plate which extend through the entire thickness of the face plate. Such a configuration increases the flexibility of the face plate. Further, according to aspects of this disclosure, the filler may be comprised of a material that will readily absorb the deflection of the face plate during an impact with a golf ball during a golf swing. For example, the filler may be a dampening material which dampens the impact between a golf club head and a golf ball.

A golf club head configured according to aspects of the disclosure can be particularly advantageous. For example, as will be described in detail below, the increased flexibility of the face plate and the positioning of the filler behind the face plate may act to impart increased spin (e.g., back spin) to a golf ball struck by the golf club head. The spin imparted by the golf club head according to aspects of the disclosure, may cause the ball flight, or trajectory of the golf ball, to be more "lofted" and, also, cause the golf ball to roll less once it lands. Therefore, such a golf club head configuration which provides more spin, less roll and higher ball flight, provides enhanced ball control (e.g., stopping the ball on the green). It is noted that such a golf club head may be particularly useful in "short" irons or wedges.

Additional aspects of this disclosure relate to iron-type golf club structures that include golf club heads, e.g., of the types described above. Such iron-type golf club structures further may include one or more of: a shaft member attached to the club head (optionally via a separate hosel member or a hosel member provided as a part of one or more of the club head and/or shaft); a grip or handle member attached to the shaft member; etc.

Still additional aspects of this disclosure relate to methods for producing iron-type golf club heads and iron-type golf club structures in accordance with examples of this disclosure. Such methods may include, for example, one or more of the following steps in any desired order and/or combinations: (a) providing a golf club head body of the various types described above (including any or all of the various structures, features, and/or arrangements described above), e.g., by manufacturing or otherwise constructing the golf club head body, by obtaining it from a third party source, etc.; (b) engaging a shaft member with the golf club head body; and (c) engaging a grip member with the shaft member.

Given the general description of various example aspects of the disclosure provided above, more detailed descriptions of various specific examples of golf clubs and golf club head structures according to the disclosure are provided below.

II. DETAILED DESCRIPTION OF EXAMPLE GOLF CLUB HEADS, GOLF CLUB STRUCTURES, AND METHODS ACCORDING TO THE DISCLOSURE

The following discussion and accompanying figures describe various example golf clubs and golf club head structures in accordance with the present disclosure. When the same reference number appears in more than one drawing, that reference number is used consistently in this specification and the drawings to refer to the same or similar parts throughout.

More specific examples and features of iron-type golf club heads and golf club structures according to this disclosure will be described in detail below in conjunction with the example golf club structures illustrated in FIGS. 1-3.

FIG. 1A generally illustrates an example of a portion of an iron-type golf club 100 according to aspects of the disclosure. As seen in FIG. 1A, the iron-type golf club head 100 may include a golf club head 102 in accordance with the present disclosure. In addition to the golf club head 102, the overall golf club structure 100 of this example includes a hosel 104, a shaft member 106 received in and/or inserted into and/or through the hosel 104, and a grip or handle member (not shown) attached to the shaft member 106. Optionally, if desired, the hosel 104 may be eliminated and the shaft member 106 may be directly inserted into and/or otherwise attached to the golf club head 102 (e.g., through an opening provided in the top of the club head 102, through an internal hosel member (e.g., provided within an interior chamber defined by the club head 102), etc.). The hosel 104 may be integrally formed as part of the club head structure 102, or it may be separately formed and engaged therewith (e.g., by adhesives or cements; by welding, brazing, soldering, or other fusing techniques; by mechanical connectors; etc.). Conventional hosels and their inclusion in an iron type club head structure may be used without departing from this disclosure.

The shaft member 106 may be received in, engaged with, and/or attached to the club head 102 in any suitable or desired manner, including in conventional manners known and used in the art, without departing from the disclosure. As more specific examples, the shaft member 106 may be engaged with the club head body 102 via the hosel 104 and/or directly to the club head structure 102, e.g., via adhesives, cements, welding, soldering, mechanical connectors (such as threads, retaining elements, or the like), etc.; through a shaft-receiving sleeve or element extending into the club head 102; etc. If desired, the shaft 106 may be connected to the golf club head 102 in a releasable manner using mechanical connectors to allow easy interchange of one shaft for another on the head.

The shaft member 106 also may be made from any suitable or desired materials, including conventional materials known and used in the art, such as graphite based materials, composite or other non-metal materials, steel materials (including stainless steel), aluminum materials, other metal alloy materials, polymeric materials, combinations of various materials, and the like. Also, the grip or handle member (not shown) may be attached to, engaged with, and/or extend from the shaft member 106 in any suitable or desired manner, including in conventional manners known and used in the art, e.g., using adhesives or cements; via welding, soldering, brazing, or the like; via mechanical connectors (such as threads, retaining elements, etc.); etc. As another example, if desired, the grip or handle member (not shown) may be integrally formed as a unitary, one-piece construction with the shaft member 106. Additionally, any desired grip or handle member materials may be used without departing from this disclosure, including, for example: rubber materials, leather materials, rubber or other materials including cord or other fabric material embedded therein, polymeric materials, and the like.

Figure 1B:
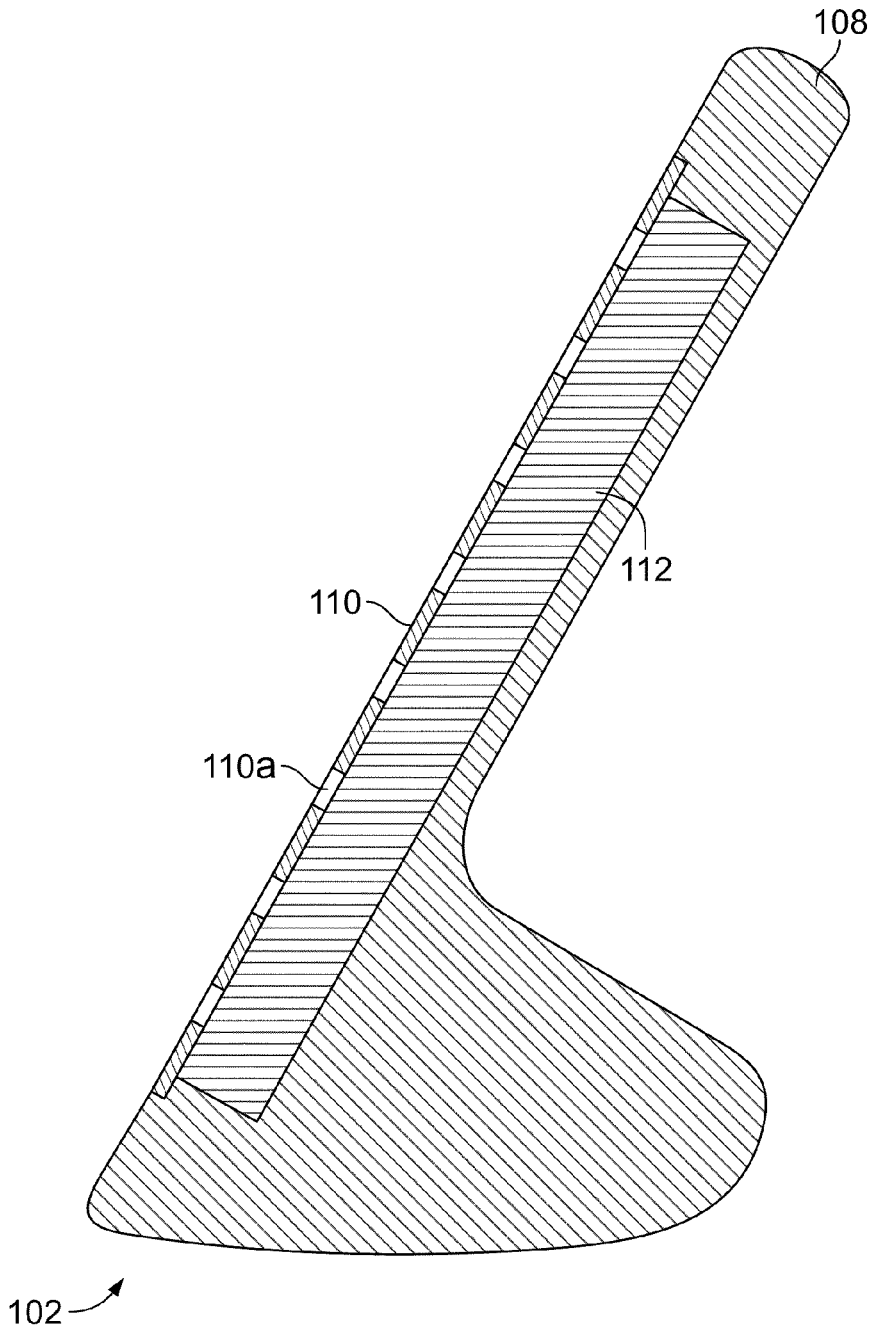
FIG. 1B is a cross-sectional view of the golf club head shown in FIG. 1A, taken along line 1B-1B.
Figure 1C:
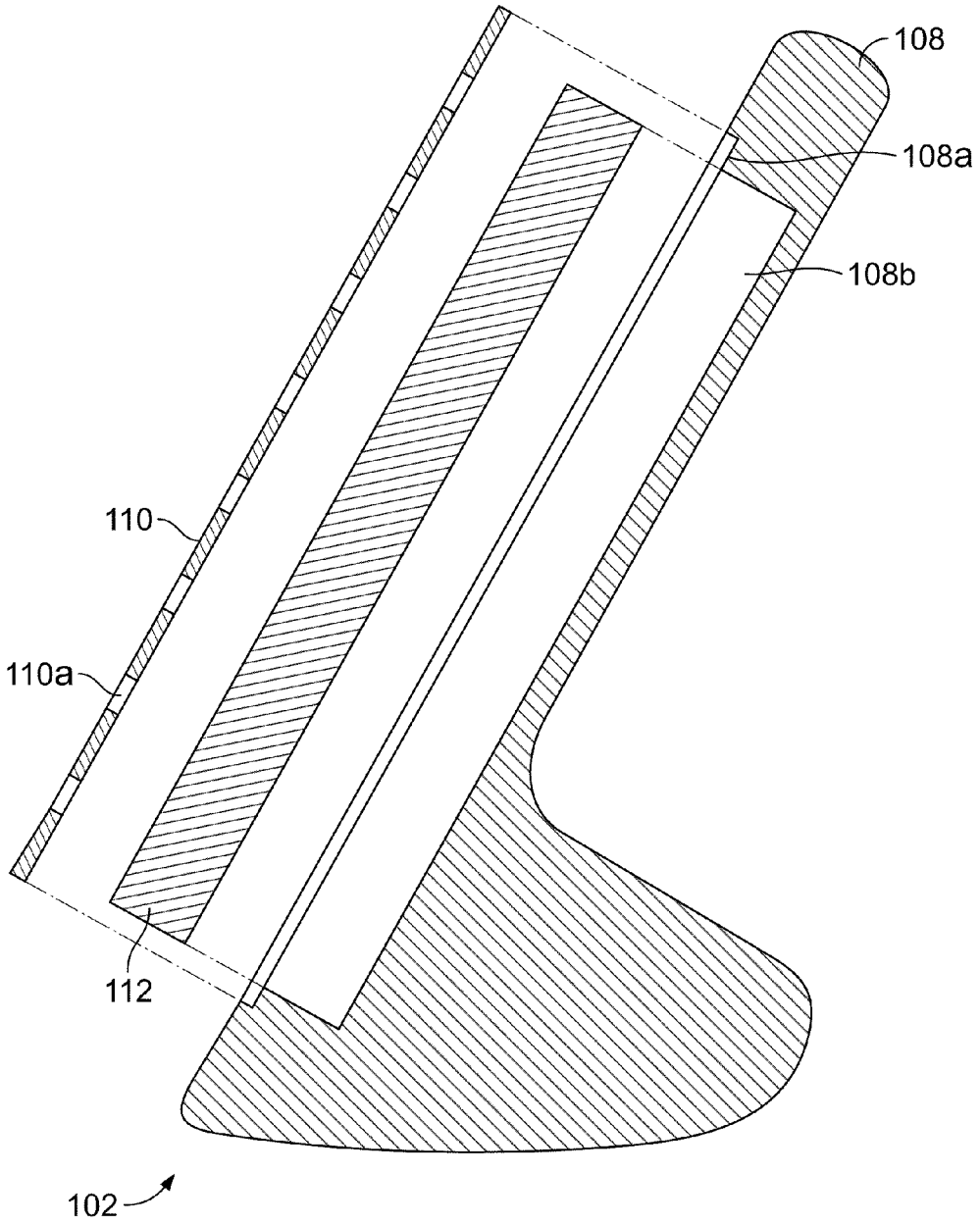
FIG. 1C is an exploded view of the golf club head shown in FIG. 1B.

Aspects of the disclosure relate to particular structures of the golf club head 102. FIGS. 1A-1C illustrate various views of a golf club head 102 according to one embodiment of this disclosure. As seen in FIG. 1A-C, the golf club head 102 includes the golf club head body 108, the ball striking face member, or face plate, 110 and the filler 112. Specifically, FIG. 1A is a front view of an illustrative embodiment of the golf club head 102 according to aspects of the disclosure. FIG. 1B is a cross-sectional view of embodiment of the golf club head 102 shown in FIG. 1A. FIG. 1C is an exploded view of the embodiment of the golf club head 102 shown in FIG. 1A.

According to aspects of the disclosure, the golf club head 102 may include the golf club head body 108, the ball striking face member (e.g., the face plate) 110 which is configured to be engaged with the golf club head body 108, and the filler 112 which is configured to be engaged with the golf club head body 108. Further, according to aspects of the disclosure, the face plate 110 may have a relatively high degree of flexibility and the filler 112 may be positioned within the golf club head body 108 and behind the face plate 110. According to aspects of the disclosure, the filler 112 may be configured to absorb the relatively large amount of deflection of the face plate 110 during an impact between golf ball and the golf club head 102 and to dampen the impact between a golf ball and the golf club head 102.

Further, as will be described in detail below, configuring the golf club head 102 according to aspects of the disclosure may allow the golfer to increase the back spin imparted to the golf ball during a golf shot. For example, the face plate 110 may have increased flexibility. The increased flexibility of the face plate 110 will increase the amount that the face plate 110 is able to deflect during impact. Further, due to the increased amount of deflection during impact, the time during which the golf ball is in contact with the face plate 110 is increased, while the amount of force imparted to the golf ball through the impact is decreased.

Additionally, the filler 112 positioned behind the flexible face plate 110 further increases time during which the golf ball is in contact with the face plate 110 and further decreases the force imparted to the golf ball through impact with the golf club head 102. For example, the filler 112 may be a dampening material which is contacted by the face plate 100 during the deflection of the flexible face plate 110 at impact. Therefore, the filler 112 tends to dampen the impact and absorb the force from the impact. Hence, the filler 112 lessens the force being imparted to the golf ball.

Therefore, each of the above described features of a golf club head 102 according to aspects of the disclosure, alone, and in combination, may decrease the force imparted to the golf ball during impact. As a result, the speed at which the golf ball leaves the face plate 110 is also decreased. Consequently, the distance the golf ball travels is lessened compared with a golf club head with a stiffer face plate and no filler positioned behind the face plate.

According to aspects of the disclosure, the face plate 110 of the golf club head 102 body may include score lines 110*a*. The score lines 110*a* may be formed by traditional scoring processes which include the removal of material from the face plate 110. Alternatively, score lines 110*a* may be formed by other processes which do not include the removal of material. For example, the score lines 110 may be defined by openings in the face plate formed during the creation of face plate 110. The score lines 110*a* may interact with the dimpled surface of the golf ball during the impact of the golf club head 102 with a golf ball (e.g., during a golf swing) and affect the aerodynamics of the golf ball during the golf shot. For example, the score lines 110*a* may cause a spin (e.g., back spin) of the golf ball during the golf shot. Further, it is noted that the more force with which the golf club head 102 impacts the golf ball, the greater amount of spin imparted to the golf ball will be.

Hence, according to aspects of the disclosure, due to the above described configuration of the golf club head wherein the face plate 110 has a relatively high degree of flexibility and the filler 112 is configured behind the face plate to dampen the impact and readily absorb force from the impact of the face plate 110 and the golf ball, the golfer may impart a greater amount of force to the ball during impact (e.g., the golfer may swing harder) without the golf ball traveling farther. However, due to the score lines 110*a*, the greater amount of force will produce a larger amount of spin on the golf ball during the golf shot. Hence, according to aspects of the disclosure, the golf club head may allow the golfer to swing harder and, thereby, increase control over the golf shot.

Further, as mentioned above, according to aspects of the disclosure, the increased flexibility of the face plate 110 allows the face plate 110 to deflect to a larger degree. Additionally, the filler 112 positioned behind the flexible face plate 110 may cushion and allow the face plate 110 to deflect to a larger degree than a more rigid member positioned behind the face plate 110. Hence, due to the relatively large amount of deflection of the face plate 110 during impact with the golf ball, the face plate 110 may become more concave and tend to wrap around the golf ball, thereby, increasing the area of the face plate 110 that is in contact with the golf ball. As a result, more score lines 110*a* are contacting more areas of the dimpled surface of the golf ball during the impact. Hence, more spin (e.g., back spin) may be imparted to the golf ball during the golf shot.

Having provided the reader with a general understanding of various features of golf club heads according to aspects of the disclosure, elements which comprise the golf club head 102 as will be described in detail below with reference to FIGS. 1A-1C.

As discussed above, the golf club head 102 may include the golf club head body 108. It is noted that the golf club head body 108 itself also may be constructed in any suitable or desired manner and/or from any suitable or desired materials without departing from this disclosure, including from conventional materials and/or in conventional manners known and used in the art. For example, the club head body 108 and/or its various parts may be made by forging, casting, molding, and/or using other techniques and processes, including techniques and processes that are conventional and known in the art. According to aspects of the disclosure, the golf club head body 108 may be a blade type iron golf club head.

According aspects of the disclosure, the golf club head body 108 may be configured to engage with the face plate 110. For example, as shown in FIG. 1C, the golf club head body 108 may include a structure, such as a recess, notch or other configuration 108*a* for receiving the face plate 110.

According to aspects of the disclosure, the golf club head body 108 may be configured to engage with the filler 112. For example, as shown in FIG. 1C, the golf club head body 108 may include a structure, such as the recess, cavity or other configuration 108*b* for receiving the filler 112.

According to aspects of the disclosure, the face plate 110 may be configured as a relatively thin sheet. As seen in FIG. 1A, according to aspects of the disclosure, the face plate 110 may have a generally trapezoidal shape which extends between the crown and sole of the golf club head 102 and, further, extends substantially between the toe and the heel of the golf club head 102. Of course, the face plate 110 may have other configurations as well.

According to aspects of the disclosure, the face plate 110 may be configured to be engaged with the golf club head body 108. For example, as seen in the depicted embodiment, the perimeter of the face plate 110 may be configured to engage with a corresponding structure of the golf club head body 108 such as the recess, notch or other configuration 108*a* for receiving the face plate 110. As seen in FIGS. 1B and 1C, the recess 108*a* is in communication with the recess or cavity 108*b* and, further, extends beyond 108*b*. According to aspects of the disclosure, the face plate 110 may be engaged with the golf club head body 108 in a variety of ways. For example, the face plate 110 may be engaged with the golf club head body 108 by press fitting, bonding with adhesives or cements, welding (e.g., laser welding), soldering, brazing, or other fusing techniques, mechanical connectors, etc.

As discussed above, according to aspects of the disclosure, the face plate 110 may exhibit a relatively high degree of flexibility. According to aspects of the disclosure, many features of the face plate 110 including the thickness of the face plate 100, the material(s) from which the face plate 110 is comprised, the configuration of score lines in the face plate 110, etc. may be configured to provide the appropriate amount of enhanced flexibility.

For example, according to aspects of the disclosure, the face plate 110 may have a depth, or thickness, in the range of about 0.3-4.0 mm, 1.0-2.0 mm, 0.30 mm-0.60 mm, 0.35 mm-0.55 mm or 0.40-0.50 mm. According to particular aspects of the disclosure, the face plate 110 may have thickness of approximately 0.45 mm. According to particular aspects of the disclosure, the face plate 110 may have a thickness of approximately 1.00 mm or 2.00 mm. It is noted that according to aspects of the disclosure, the thickness of face plate 110 may be uniform throughout the face plate 110. Further, according to other aspects of the disclosure, the thickness of the face plate 110 may vary throughout the face plate 110. For example, the thickness of the face plate 110 may be thicker in some regions (e.g., the perimeter of the face plate 110) and thinner in other regions (e.g., the center of the face plate 110). In this way, the center of the face plate, which is the ideal location of the face plate 110 for contacting the golf ball during a golf swing (i.e., "the sweet spot"), may be more flexible than the perimeter of the face plate 110.

According to aspects of the disclosure, the face plate 110 may be comprised of one or more materials. The material(s) of the face plate 110 should be relatively durable to withstand the repeated impacts with the golf ball. Further, the material (s) of the face plate 110 should have a relatively high degree of flexibility in order to provide the above described deflection. According to aspects of the disclosure, the face plate 110 may be made of a high strength material with a low Young's Modulus. According to aspects of the disclosure, the face plate 110 may comprise a high strength steel. For example, a high strength steel, such as SUP 10, HT1770, etc. may be used. Further, other materials such as titanium or other metals or alloys may be used as well.

As mentioned above, according to aspects of the disclosure, the face plate 110 may include a plurality of score lines 110*a* which extend generally horizontally across the face plate 110. According to aspects of the disclosure, a score line 110*a* may extend partially, substantially, or completely across the face plate 110.

According to aspects of the disclosure, and as seen in FIGS. 1B and 1C, the score lines 110*a* may extend completely through the thickness of the face plate 110. In other words, the score lines 110*a* may define a plurality of openings or holes in the face plate 110. By creating a plurality of holes which extend through the thickness of the face plate 110, the score lines 110*a* allow the face plate 110 to deform and deflect more readily as compared to a face plate without any openings (e.g., a face plate that includes score lines that do not extend completely through the face plate to define openings in the face plate). In fact, the face plate 110 including openings or holes extending through the thickness of the face plate 110 will have much greater degree of flexibility than a face plate without any openings.

According to aspects of the disclosure, the number of score lines 110*a* and/or the dimensions of each of the score lines 110*a* may be varied as desired. For example, according to aspects of the disclosure, and as seen in the cross-sectional view shown in FIG. 1B, the score lines 110*a* may have a relatively square or rectangular cross-sectional shape. Alternatively, the portions of the face plate 110 defining the score line may be tapered such that the cross-sectional shape of the score line 110*a* may resemble a "V" or "U" shape, wherein the hole defined by the score line 110*a* becomes narrower as it extends toward the club head body 108.

According to aspects of the disclosure, the golf club head may include the filler 112. According to aspects of the disclosure, the filler 112 may be configured to engage with the club head body 108. For example, as seen in FIG. 1B, the filler 112 may be inserted into the cavity 108*b* of the golf club head body 108. According to aspects of the disclosure, and as seen in FIG. 1B, the cavity 108*b* may be an internal cavity configured such that the filler 112 is entirely contained within the golf club head 102 and not exposed except for the exposure of the filler 112 through the openings in the face plate 110 as will be described below.

According to aspects of the disclosure, the filler 112 and the cavity 108*b* of the golf club head body 108 may be configured such that the filler 112 is positioned behind the face plate 110 and such that the filler 112 substantially or entirely occupies the space between the face plate 110 and the golf club head 108. Further, according to aspects of the disclosure, the filler 112 and the cavity 108*b* of the golf club head body 108 may be configured such that the filler 112 engages with the face plate 110, when the face plate 110 is engaged with the golf club head body 108. For example, as seen in FIG. 1B, according to aspects of the disclosure, the filler 112 may contact the side of the face plate 110 facing the cavity 108*b* of the golf club head body 108. Further, according to aspects of the disclosure, the filler 112 may extend throughout the club head body 108 such that the filler 112 defines an edge of the holes in the face plate 110 defined by the score lines 110*a*. Further, according to aspects of the disclosure, the filler 112 may be positioned entirely behind the rear side of the face plate 110, such that the holes remain void of any material.

According to aspects of the disclosure, the filler 112 may extend in a continuous fashion throughout a substantial portion of the golf club head body 108. For example, according to aspects of the disclosure, the filler 112 may extend in a continuous fashion behind a substantial portion or the entirety of the face plate 110. For example, as seen in the front view of the embodiment of the golf club shown FIG. 1A, the filler 112 extends throughout the club head body 108 such that the filler 112 is visible through each of the holes in the face plate 110 defined by the score lines 110*a*.

As discussed above, according to aspects of the disclosure, the filler 112 may be positioned behind the face plate 110 in order to absorb the deflection of the face plate during impact of the golf club head 102 with the golf ball and to dampen the impact and absorb the force of the impact. According to aspects of the disclosure, many features of the filler 112, including the material(s) from which the filler 112 is comprised, the thickness of the filler 112, etc. may be configured to provide the appropriate amount of dampening and absorption.

According to aspects of the disclosure, the filler 112 may comprise a material that is less rigid than the face plate 110. For example, the filler 112 may include a plastic or rubber material. Further, the filler 112 may include a metal or alloy material. Further, the filler 112 may include composite materials, polymer materials, gels, etc. Further, according to aspects of the disclosure, the filler 112 may include a resin.

According to aspects of the disclosure, the filler 112 may have a depth, or thickness, in the range of about 1.0 mm-4.0 mm, 2.0 mm-3.0 mm or 2.25-2.75 mm. According to particular aspects of the disclosure, the filler 112 may have a thickness of approximately 1.00 mm or 2.00 mm. Of course, the thickness of the filler may be varied based on different factors including the material(s) of which the filler 112 is comprised. It is noted that according to aspects of the disclosure, the thickness of the filler 112 may be uniform throughout the filler 112. Further, according to aspects of the disclosure, the thickness of the filler 112 may vary throughout. For example, the thickness of the filler may be thicker in some regions and thinner in other regions.

According to aspects of the disclosure, the filler 112 may be one or more piece(s) of a relatively solid material that is inserted into the club head body 108. For example, the filler may be one or more piece(s) of a rubber or plastic. According to aspects of the disclosure, the filler 112 may be engaged with the golf club head body 108 by press fitting, bonding with adhesives or cements, welding (e.g., laser welding), soldering, brazing, or other fusing techniques, mechanical connectors, etc.

According to aspects of the disclosure, the filler 112 may be a material that is capable of being injection molded into the golf club head body 108, such as a thermoset plastic. For example, the filler 112 may be injection molded into the golf club head body 108 during manufacture of the golf club head 102.

Further, according to aspects of the disclosure, the filler 112 may be contained in one or more smaller, localized regions of the golf club head body 108. For example, according to aspects of the disclosure, the filler 112 may be positioned behind a portion of the face plate 110 (e.g., the center of the face plate 110), instead of behind the entirety of the face plate 110. Further, according to aspects of the disclosure, the filler 112 may be positioned behind a lower portion of the face plate 110 (e.g., a lower half or lower third of the face plate 110) and not an upper portion of the face plate 110 (e.g., an upper half or upper third of the face plate 110). Further, it is noted that the cavity 108*b* of the golf club head body 108 would be sized and configured to accommodate the size and configuration of the filler 112. Further, it is noted that according to aspects of the disclosure, the filler 112 may be positioned in smaller, localized regions which are separate from each other.

A wide variety of overall club head constructions are possible without departing from this disclosure. For example, it is noted that the dimensions and/or other characteristics of a golf club head 102 according to examples of this disclosure may vary significantly without departing from the disclosure. For example, while the above described configuration may be particularly useful in wedges (e.g., pitching wedges, lob wedges, gap wedges, sand wedges, etc.), the features described above may be incorporated into any iron-type club head including, for example: iron-type hybrid clubs, driving irons, 0 through 10 irons, etc.

Figure 1D:
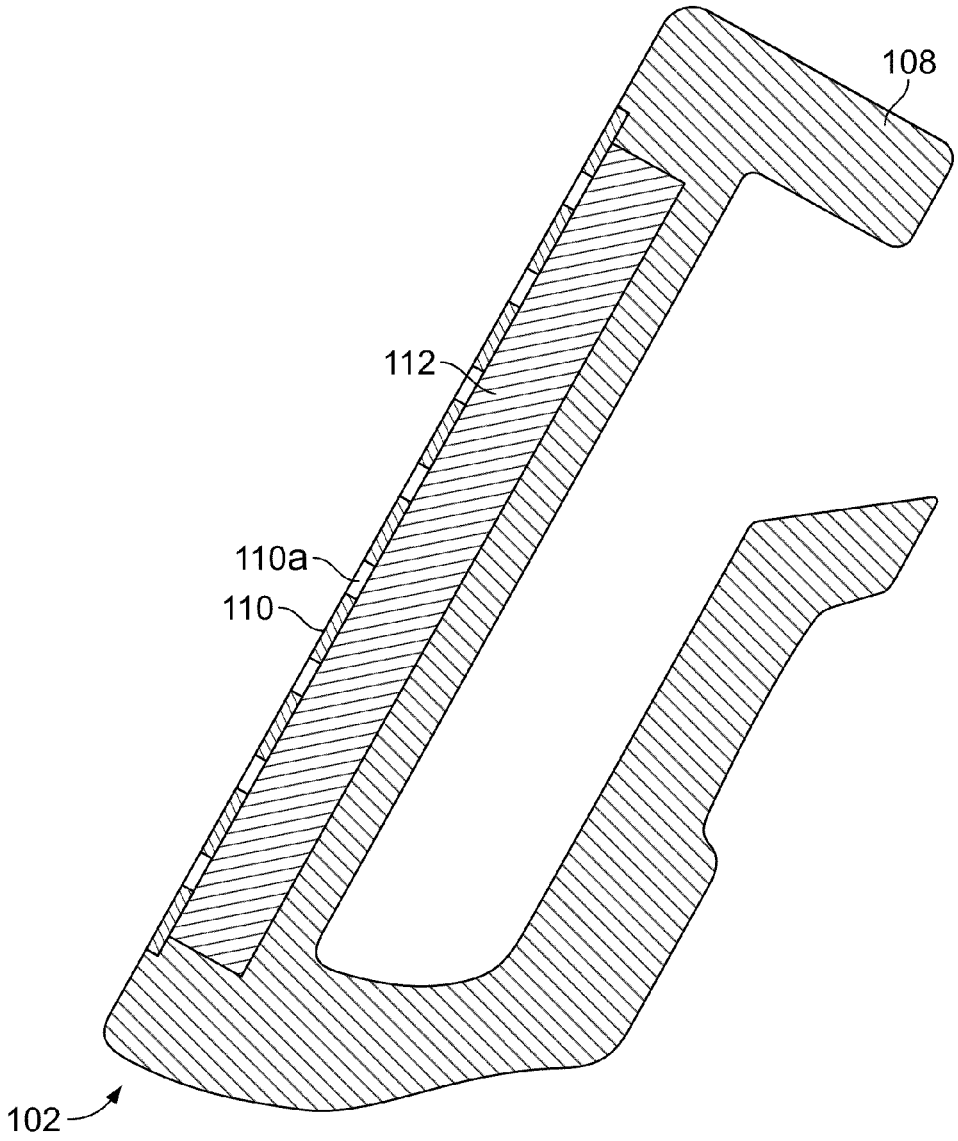
FIG. 1D is a cross-sectional view of a golf club head according to aspects of the disclosure.

Further, while the above described embodiment discussed aspects of the disclosure with reference to a blade type iron, alternatively, if desired, the golf club head body 108 may be a perimeter weighted and/or cavity back type golf club head or other iron type golf club head structure without departing from this disclosure. For example, FIG. 1D illustrates a perimeter weighted and/or cavity back type golf club head including the golf club head body 108 according to aspects of the disclosure, wherein the golf club head body 108 includes a rear surface opposite the ball striking face which includes a perimeter weighting member extending rearward from the ball striking face and along at least a portion of a circumferential area of the golf club head body.

Figure 2A:
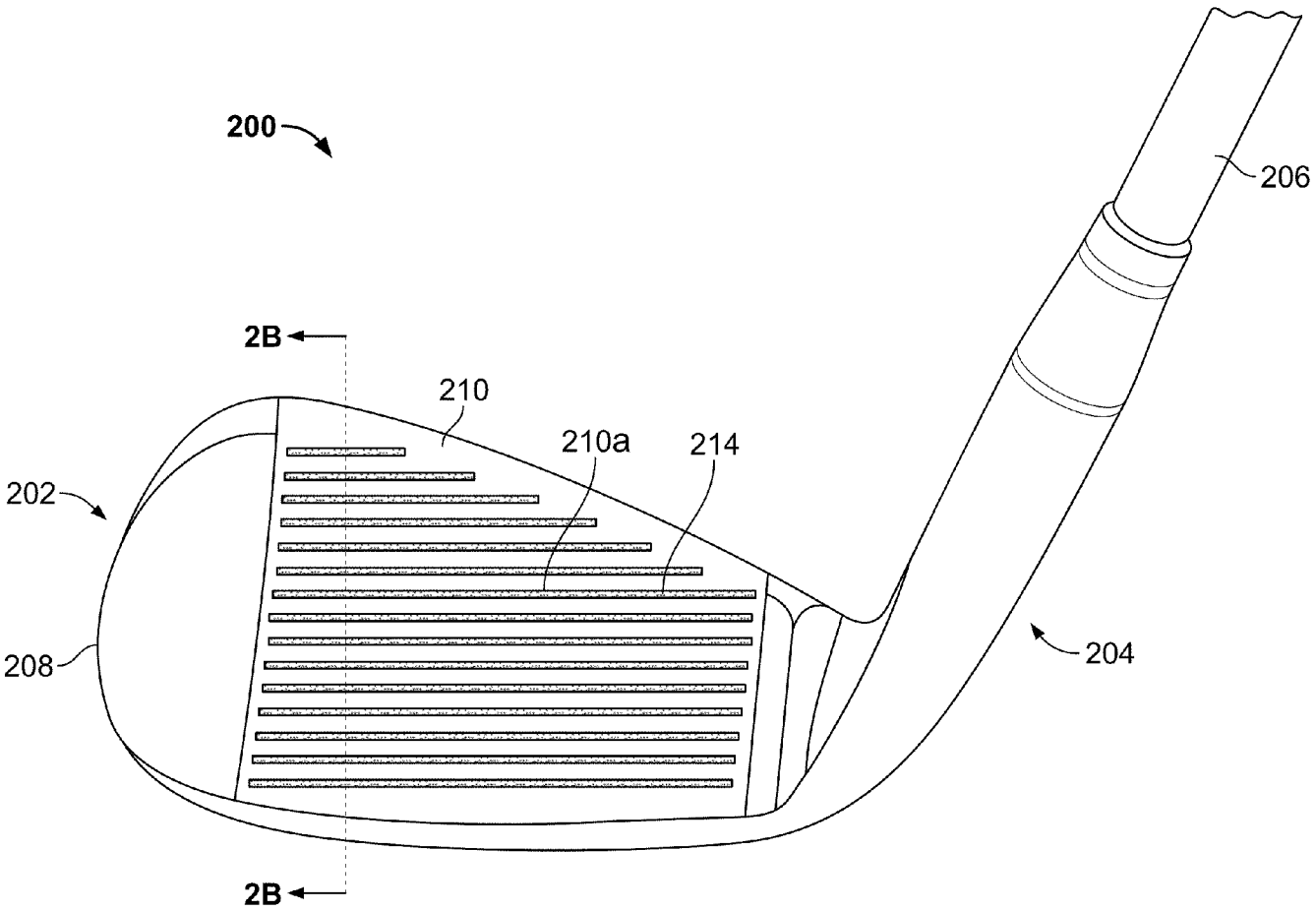
FIG. 2A is an illustrative embodiment of a golf club structure according to aspects of the disclosure.
Figure 2B:
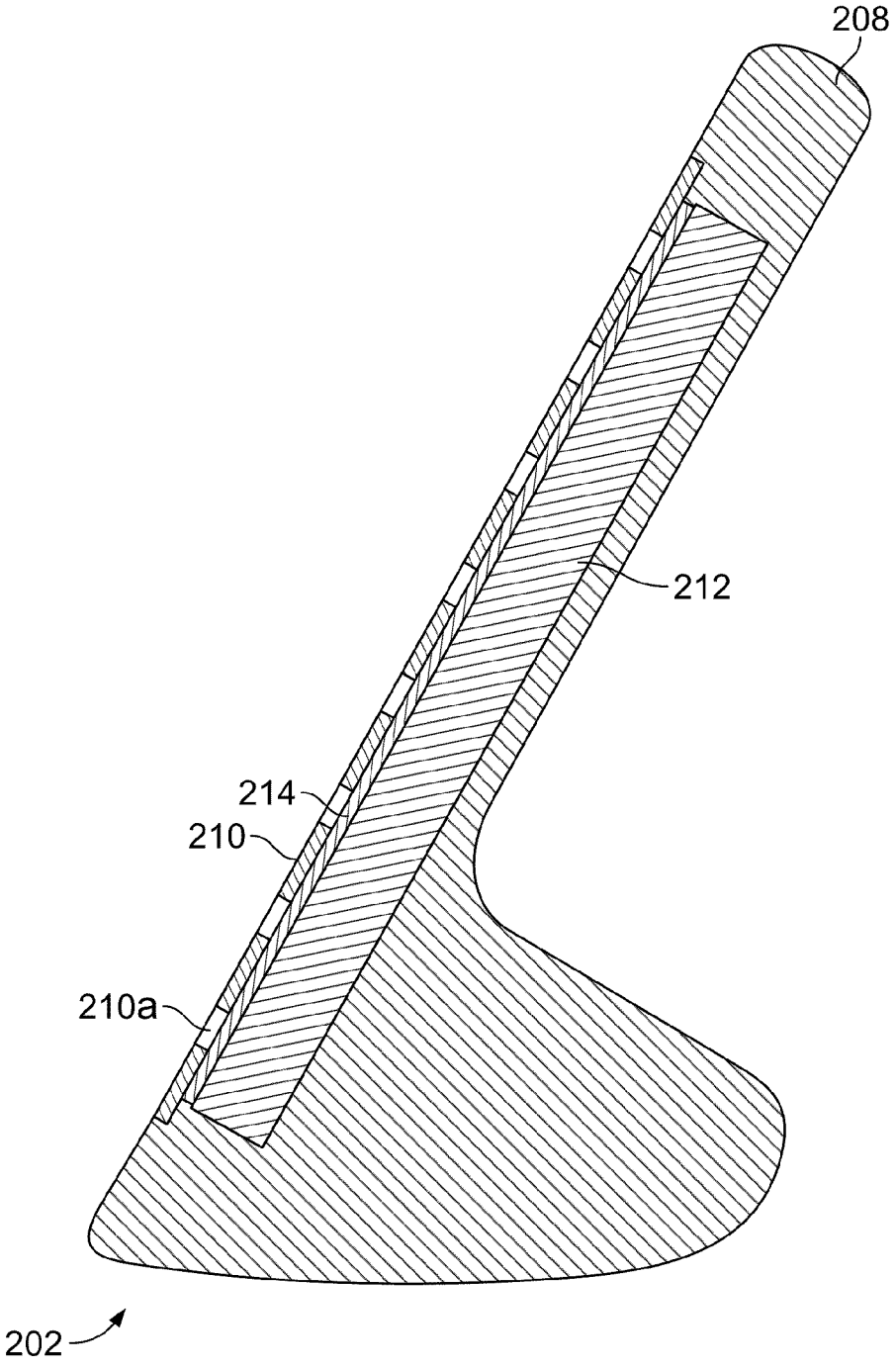
FIG. 2B is a cross-sectional view of the golf club head shown in FIG. 2A, taken along line 2B-2B.
Figure 2C:
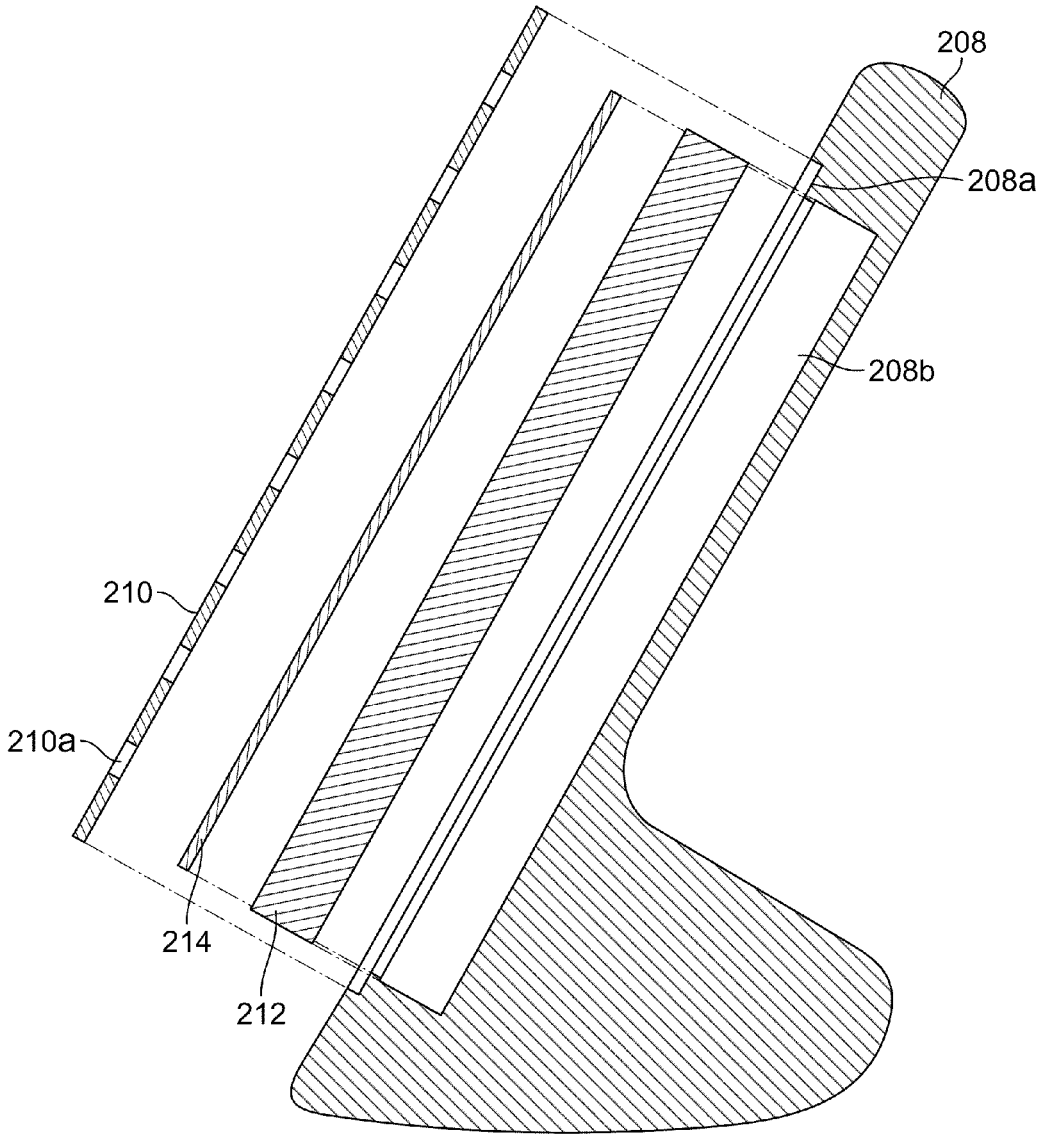
FIG. 2C is an exploded view of the golf club head shown in FIG. 2B.

FIGS. 2A-2C illustrate various views of a golf club head 202 according to a second embodiment of this disclosure. Specifically, FIG. 2A is a front view of an illustrative embodiment of a golf club head 202 according to aspects of the disclosure. FIG. 2B is a cross-sectional view of embodiment of the golf club head 202 shown in FIG. 2A. FIG. 2C is an exploded view of the embodiment of the golf club head 202 shown in FIG. 2A.

It is noted that several aspects of the second embodiment are similar to features of the above recited embodiment and, therefore, for the sake of brevity, will not be reiterated here. As seen in FIGS. 2A-2C, the second embodiment of the golf club head 202 includes a barrier 214. According to aspects of the disclosure, the barrier 214 may be a relatively thin sheet or film positioned between the face plate 210 and the filler 212. According to aspects of the disclosure, the barrier 214 may be configured to contain the filler 212 in the cavity 208*b* and behind the face plate 210 (e.g., during assembly of the golf club head 202 or during play).

Therefore, according to aspects of the disclosure, the barrier 214 may be configured and positioned within the club head 202, such that the barrier 214 engages with the filler 212 when the filler 212 is inserted into the cavity 208*b* of the golf club head body 208. Hence, as seen in FIG. 2B, the barrier 214 separates the face plate 210 and the filler 212.

Further, according to aspects of the disclosure, the barrier 214 may be configured to be engaged with the golf club head body 208. For example, as seen in the depicted embodiment, the perimeter of the barrier 214 may be configured to engage with a corresponding structure of the golf club head body 208 such as a recess, notch or other configuration for engaging the barrier 214. According to aspects of the disclosure, the barrier 214 may be engaged with the golf club head body 208 in a variety of ways. For example, the barrier 214 may be engaged with the golf club head body 208 by press fitting, bonding with adhesives or cements, welding (e.g., laser welding), soldering, brazing, or other fusing techniques, mechanical connectors, etc.

According to aspects of the disclosure, the barrier 214 may extend in a continuous fashion behind the entirety or a substantial portion of the face plate 210. For example, as seen in the front view of the embodiment of the golf club shown in FIG. 2A, the barrier 214 extends throughout the club head body 208 such that the barrier 214 is visible through the entirety of the openings defined by the score lines 210*a*.

According to aspects of the disclosure, the barrier 214 is configured to engage the face plate 210. For example, according to aspects of the disclosure, the barrier 214 may be configured and positioned such that the barrier 214 engages with the face plate 210, when the face plate 210 is engaged with the golf club head body 208. For example, as seen in FIG. 2B, according to aspects of the disclosure, the barrier 214 may contact the side of the face plate 210 facing the cavity 208*b* of the golf club head body 208. Further, the barrier 214 may extend throughout the club head body 208 such that the barrier 214 defines an edge of the openings in the face plate 210 defined by the score lines 210*a*.

According to aspects of the disclosure, the barrier 214 may have a depth, or thickness, in the range of about 0.1 mm-0.2 mm. According to particular aspects of the disclosure, the barrier 214 may have thickness of approximately 0.15 mm. It is noted that according to aspects of the disclosure, the thickness of barrier 214 may be uniform throughout the barrier 214. Further, it is noted that according to aspects of the disclosure, the thickness of the barrier 214 may be relatively small in order to allow the face plate 210 to deflect relatively easily.

According to aspects of the disclosure the barrier 214 may be comprised of one or more materials. For example, according to aspects of the disclosure, the barrier 214 may be made of a metal or alloy. Further, the barrier 214 may include a plastic, rubber, composite materials, polymer materials, etc. According to aspects of the disclosure, the material(s) which comprise the barrier 214 may be relatively flexible in order to allow the face plate 210 to deflect easily.

Figure 3A:
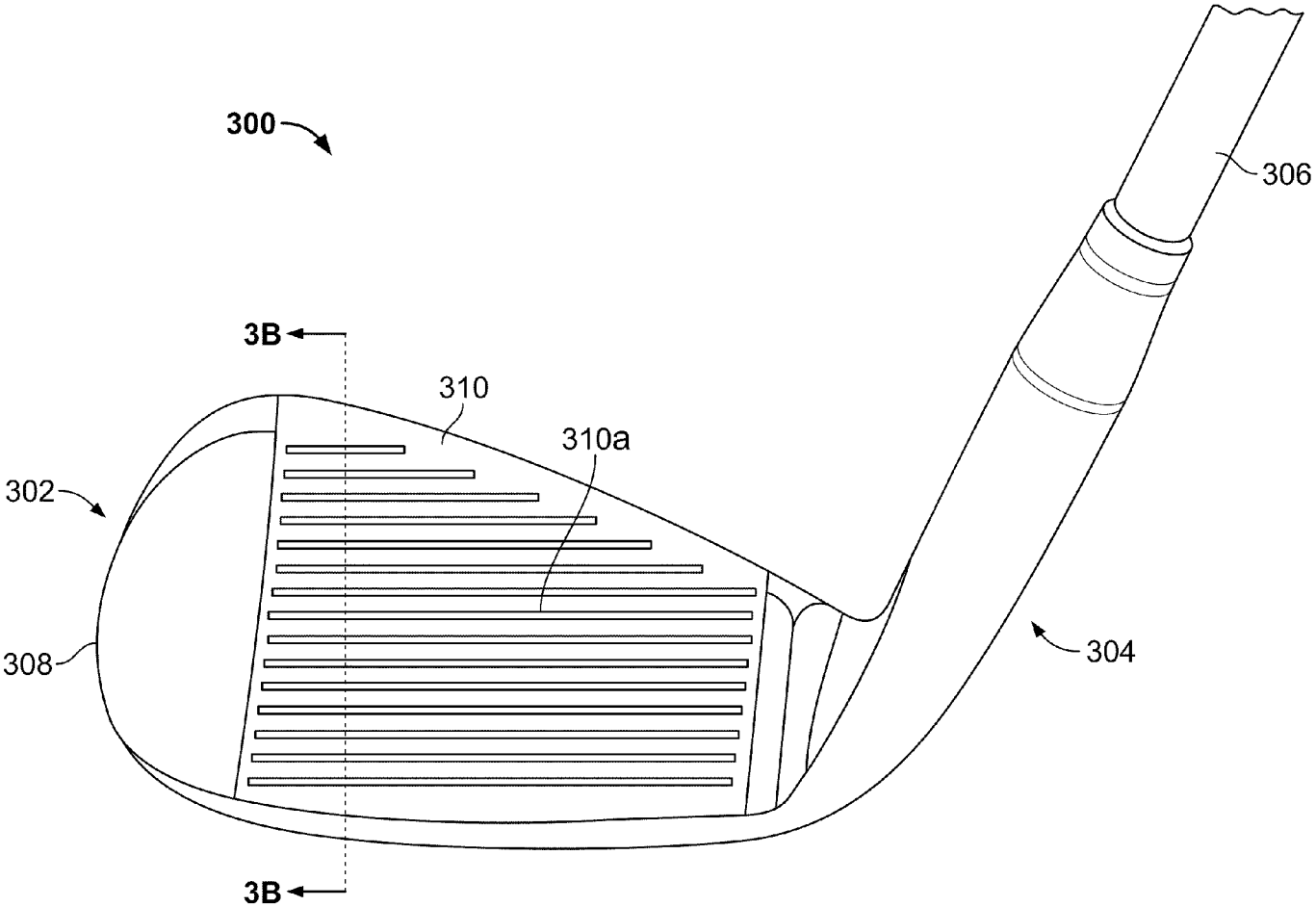
FIG. 3A is an illustrative embodiment of a golf club structure according to aspects of the disclosure.
Figure 3B:
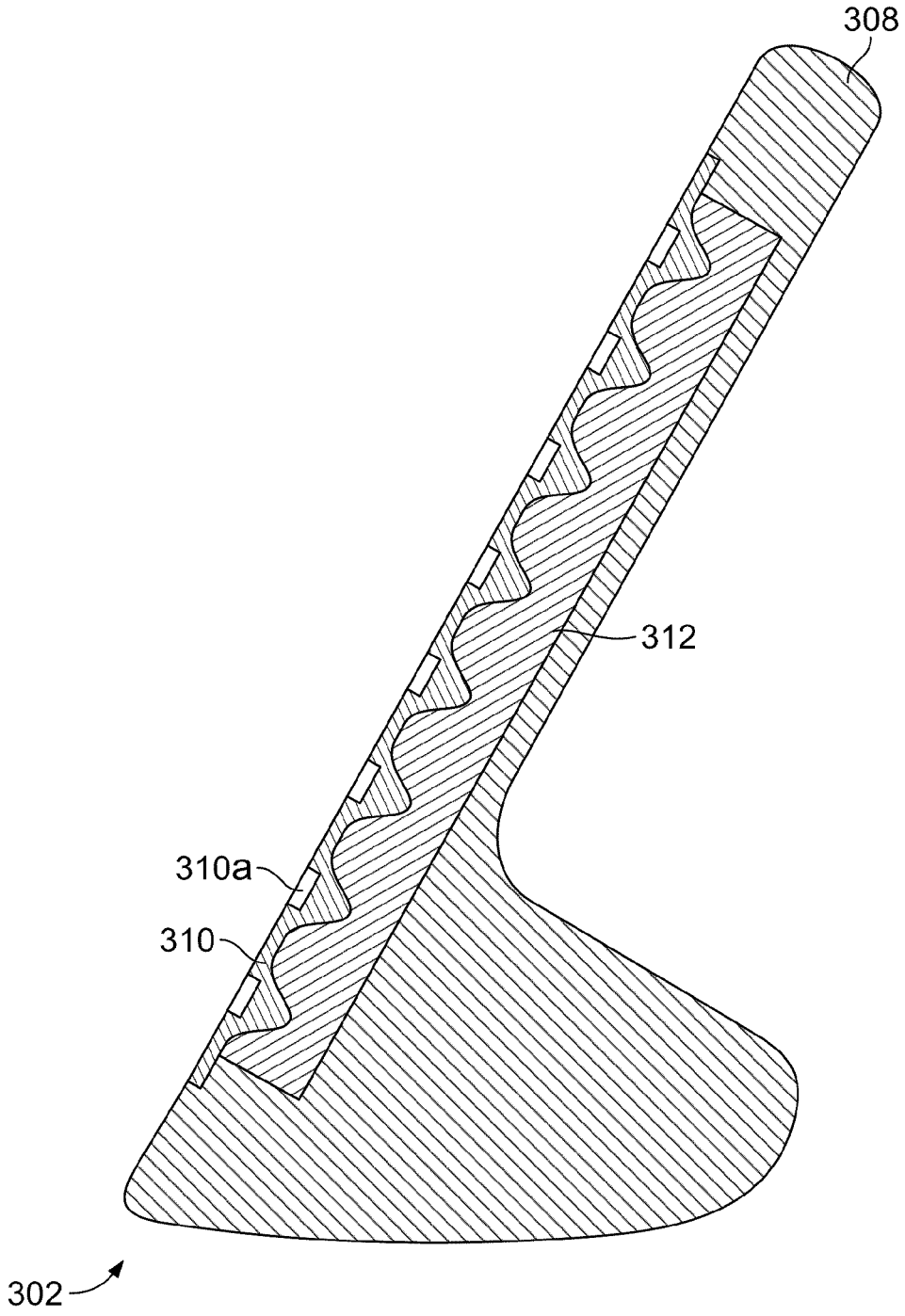
FIG. 3B is a cross-sectional view of the golf club head shown in FIG. 3A, taken along line 3B-3B.
Figure 3C:
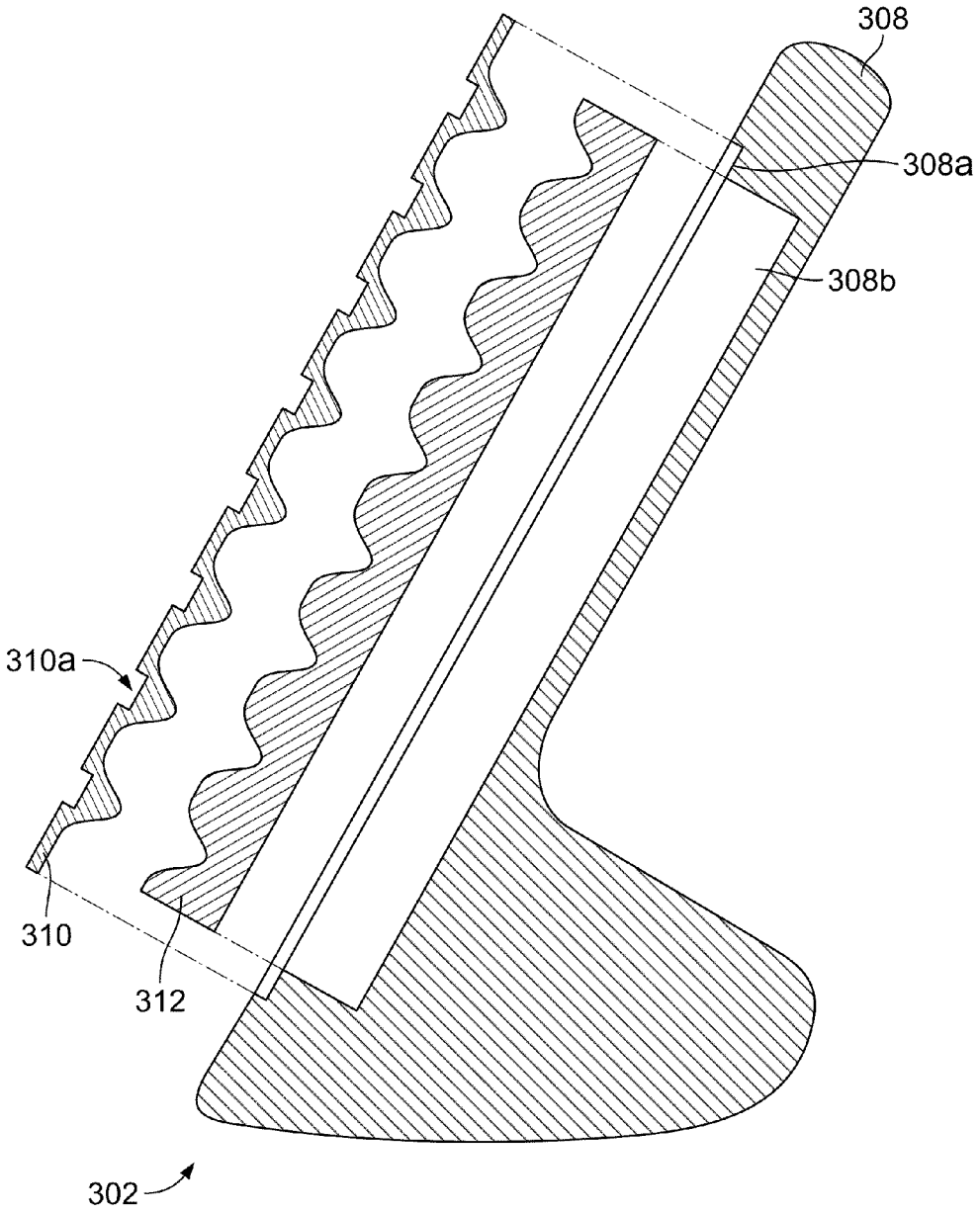
FIG. 3C is an exploded view of the golf club head shown in FIG. 3B.

FIGS. 3A-3C illustrate various views of a golf club head 302 according to a third embodiment of this disclosure. Specifically, FIG. 3A is a front view of an illustrative embodiment of a golf club head 302 according to aspects of the disclosure. FIG. 3B is a cross-sectional view of embodiment of the golf club head 302 shown in FIG. 3A. FIG. 3C is an exploded view of the embodiment of the golf club head 302 shown in FIG. 3A.

It is noted that several aspects of the third embodiment are similar to features of the first recited embodiment and, therefore, for the sake of brevity, will not be reiterated here. According to aspects of the disclosure, the golf club head 302 may include a face plate 310. According to aspects of the disclosure, the face plate 310 may be configured as a relatively thin sheet or layer with a generally trapezoidal shape which extends between the crown and sole of the golf club head 302, and, further, extends substantially between the toe and the heel of the golf club head 302. Of course, the face plate 310 may have other configurations as well.

According to aspects of the disclosure, the face plate 310 may be a continuous sheet or layer. In other words, the face plate 310 may be a sheet devoid of any holes or openings which extend entirely through the thickness of the face plate 310. For example, according to aspects of the disclosure, the face plate 310 may include the plurality of score lines 310*a* which extend generally horizontally across the face plate 310. According to aspects of the disclosure, and as seen in FIG. 3B, the score lines 310*a* may extend into the thickness of the face plate 310, but not completely through the face plate 310. In other words, the score lines 310*a* may create grooves in the face plate 301, but not holes which extend completely through the face plate 310. Therefore, the face plate 310 may be a continuous sheet.

According to aspects of the disclosure, and as best seen in FIG. 3C, the face plate 310 may include a first surface that is configured to face away from the golf club head body 308 and contact the golf ball during impact when the face plate 310 is engaged with the golf club head body 308. Further, the face plate 310 may include a second surface opposite the first surface that is configured to face towards the golf club head body 308 and engage the golf club head body 308 and the filler 312 when the face plate 310 is engaged with the golf club head body 308. According to aspects of the disclosure, the second surface may define one or more thicker regions in the face plate 310. For example, as seen in FIG. 3B, a plurality of thicker regions are configured to be in line with the score lines 310*a*. According to aspects of the disclosure, the thicker regions of the face plate 310 may increase the strength of the face plate 310.

As seen in FIG. 3B, according to aspects of the disclosure, the second surface may be configured to define the thicker regions using an undulating or sinusoidal wave like pattern. In this way, more material of the face plate 310 may be concentrated behind the grooves formed by the score lines 310*a*. This may increase the strength in these thinner areas of the face plate 310 by reinforcing such thinner areas. Further, such a configuration of the second surface may be advantageous as it does not provide additional material at areas of the face plate that may already be sufficiently strong. Hence, additional flexibility may be achieved as compared with a face plate wherein the second surface of the face plate 310 is configured to provide a thicker area which extends along the entirety, or substantially the entirety, of the faceplate 310.

Of course, the sinusoidal pattern shown in the depicted embodiment is merely an example, and other configurations may be used as well. For example, the second surface may be configured to define the thicker regions using rectangular wave like pattern. Further, if desired, according to aspects of the disclosure, the second surface of the face plate 310 may be configured to provide a thicker area which extends uniformly along the entirety, or substantially the entirety, of the faceplate 310. Such a configuration of the face plate may increase the strength and rigidity of the faceplate while decreasing the flexibility of the face plate 310.

It is noted that according to aspects of the disclosure, and as seen in FIGS. 3B and 3C, the thickness of the face plate 310 may vary throughout the face plate 310. For example, the thickness of the face plate 310 may be thicker in some regions, such as behind the grooves defined by the score lines 310*a*. Further, the face plate 310 may be thinner in some regions, such as the areas adjacent to the grooves defined by the score lines 310*a*. Hence, according to aspects of the disclosure, the face plate 310 may have a depth, or thickness, which varies depending on the particular section of the face plate. Various areas of the face plate may include a thickness in a range of about 0.30 mm-1.0 mm, 0.6 mm-0.8 mm or 0.40-0.50 mm. According to aspects of the disclosure, and as seen in FIGS. 3B and 3C, the filler 312 may be configured to correspond to the shape of the face plate 310. Further, according to aspects of the disclosure the filler 312 may have a cooperatively dimensioned surface to mate with the second surface of the face plate as shown in FIG. 3B.

Figure 4A:
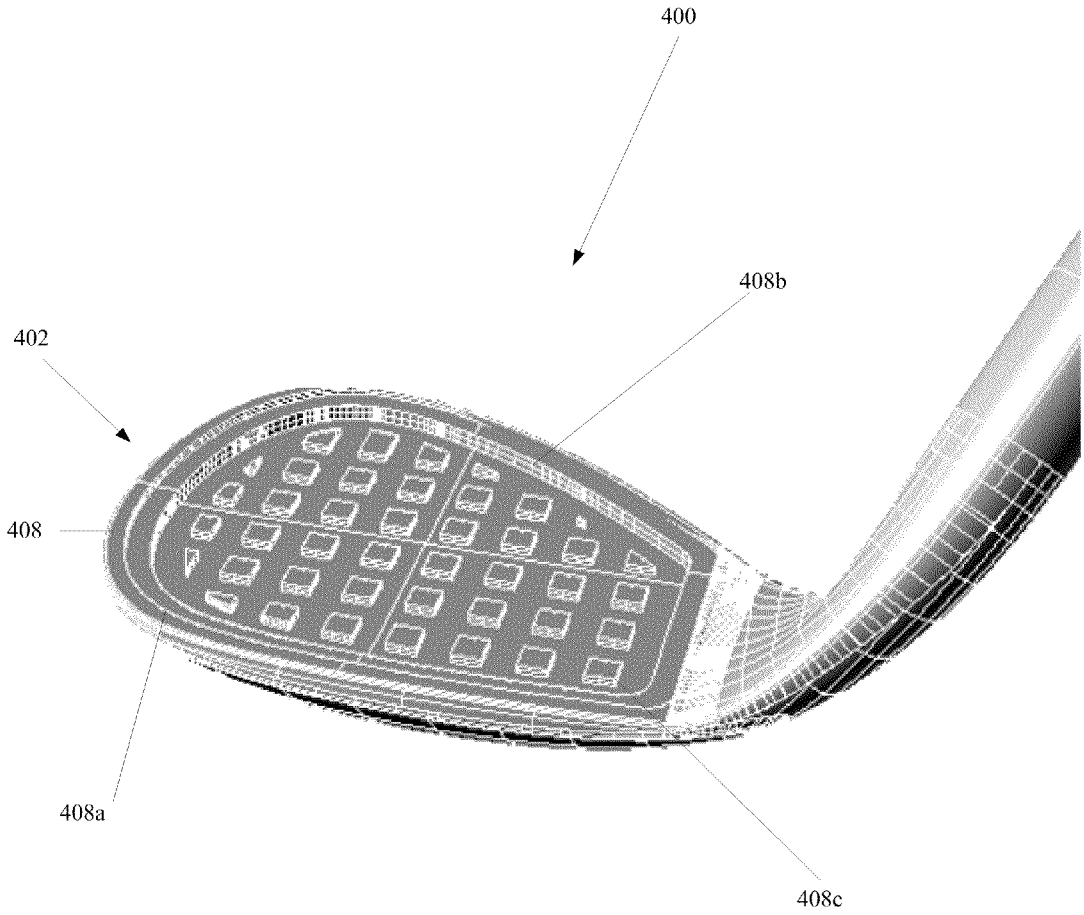
FIG. 4A is an illustrative embodiment of a golf club body structure according to aspects of the disclosure.
Figure 4B:
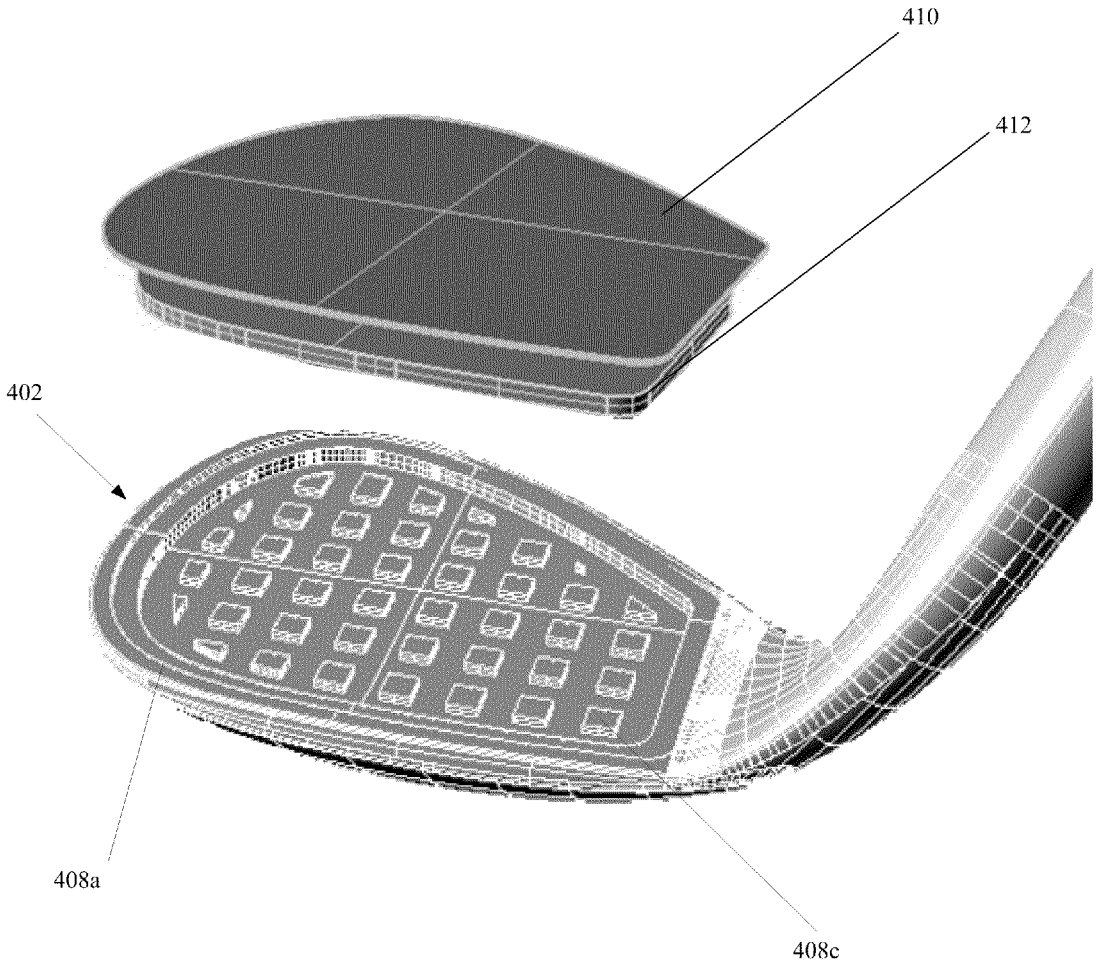
FIG. 4B is an exploded view of a golf club head according to aspects of the disclosure.
Figure 4C:
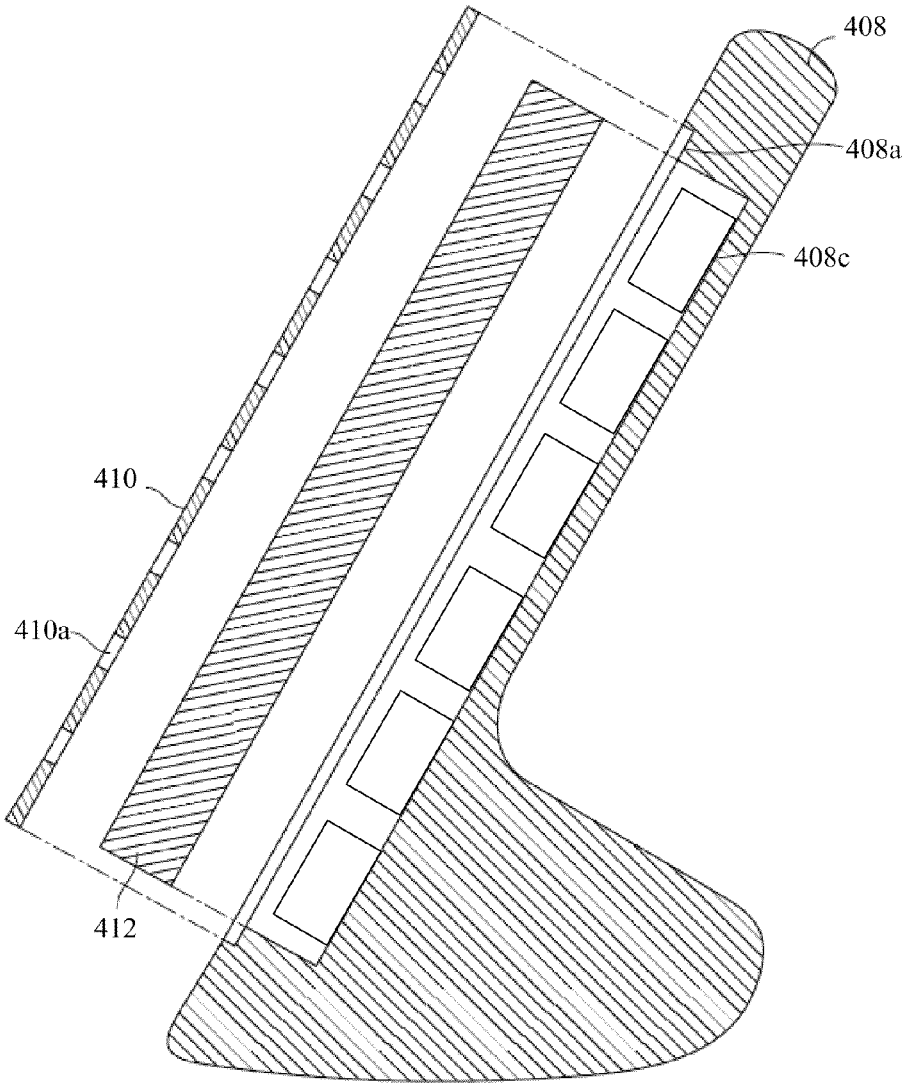
FIG. 4C is a cross-sectional view of a golf club head according to aspects of the disclosure.

FIGS. 4A-4C illustrate various views of a golf club head 402 according to a fourth embodiment of this disclosure. Specifically, FIG. 4A is a front view of an illustrative embodiment of a golf club head 402 according to aspects of the disclosure, wherein the face plate and the filler have been removed for clarity. FIG. 4B is an exploded view of the embodiment of the golf club head 402 according to aspects of the disclosure. FIG. 4C is a cross-sectional view of embodiment of the golf club head 402 according to aspects of the disclosure.

It is noted that several aspects of the fourth embodiment may be similar to features of the above described embodiments and, therefore, for the sake of brevity, will not be reiterated in detail here. For example, according to aspects of the disclosure, the golf club head 402 may include a face plate 410. The face plate may contain features disclosed in any of the above described embodiments. Further, according to aspects of the disclosure, the golf club head 402 may include a filler 412. The filler may contain features disclosed in any of the above described embodiments. Additionally, if desired, according to aspects of the disclosure, the golf club head 402 may include a barrier. The barrier may contain features disclosed in any of the above described embodiments. It is noted other features of the above described embodiments may be included in this embodiment as well if desired.

Further, according to aspects of the disclosure, the golf club head 402 may include a golf club head body 408. As seen in FIGS. 4B and 4C, according aspects of the disclosure, the golf club head body 408 may be configured to engage with the face plate. For example, as shown in FIG. 4C, the golf club head body 408 may include a structure, such as a recess, notch or other configuration 408*a* for receiving the face plate. According to aspects of the disclosure, the golf club head body 408 may be configured to engage with the filler. For example, as shown in FIGS. 4A, 4B and 4C, the golf club head body 408 may include a structure, such as the recess, cavity or other configuration 408*b* for receiving the filler.

According to aspects of the disclosure, the golf club head body 408 may include one or more protrusions 408*c* within the recess or cavity 408*b*. For example, as seen in FIGS. 4A, 4B and 4C, the golf club head body 408 may include a plurality of square or rectangular shaped protrusions. Further, as seen in the depicted embodiment, the square or rectangular shaped protrusions 408*c* may be arranged in rows and/or columns throughout the recess or cavity 408*b* (e.g., forming a "waffle" type pattern). It is noted that other types of protrusions may be used as well. For example, circular, triangular or other polygonal shapes may be used as desired. Additionally, the protrusions may be arranged in other patterns and sized as desired as well.

As seen in FIGS. 4A and 4B, according to aspects of the disclosure, the one or more protrusions 408*c* may extend from the surface of the cavity or recess 408*b* towards the face plate. Further, the one or more protrusions 408*c* may have a depth, or thickness, such that the one or more protrusions 408*c* are configured so as not to engage the face plate when the face plate is engaged with the golf club head body 408. For example, the depth, or thickness, of the one or more protrusions 408*c* may be less than the depth of the cavity or recess 408*b*. For example, according to particular embodiments of the disclosure, the depth, or thickness, of the one or more protrusions 408*c* may be a few millimeters or a few fractions of a millimeter less than the depth of the cavity or recess 408*b*.

According to aspects of the disclosure, the filler may engage the one or more protrusions 408*c* within the recess or cavity 408*b*. Further, the one or more protrusions 408*c* may limit the amount that the face plate deflects during impact with a golf ball (e.g., as compared with an embodiment in which the recess or cavity does not contain protrusions, such as shown in FIG. 1A-1D).

III. CONCLUSION

The present disclosure is described above and in the accompanying drawings with reference to a variety of example structures, features, elements, and combinations of structures, features, and elements. The purpose served by the disclosure, however, is to provide examples of the various features and concepts related to the disclosure, not to limit the scope of the disclosure. One skilled in the relevant art will recognize that numerous variations and modifications may be made to the embodiments described above without departing from the scope of the present disclosure, as defined by the appended claims. For example, the various features and concepts described above in conjunction with FIGS. 1 through 4C may be used individually and/or in any combination or subcombination without departing from this disclosure.

We claim:

1. A golf club head comprising:

an iron-type golf club head body;

a face plate having a front side and a rear side opposite the front side;

a filler positioned behind the face plate;

a cavity formed on a front surface of the golf club head body and located behind the face plate, wherein the filler is received in the cavity; and a recess formed on the front surface of the golf club head body in communication with and extending beyond the cavity, wherein the face plate is received in the recess to cover the cavity and the filler;

wherein the face plate includes a plurality of score lines which define holes that extend through the thickness of the face plate, and wherein the filler is positioned entirely behind the rear side of the face plate, such that the holes remain void of any material; and wherein the cavity and the filler extend continuously behind all of the holes.

2. A golf club head according to claim 1, wherein the face plate is configured to be engaged with the iron type golf club head body.

3. A golf club head according to claim 1, wherein the face plate has a thickness in a range of 0.40-0.50 mm.

4. A golf club head according to claim 1, wherein the score lines have a square or rectangular cross-sectional shape.

5. A golf club head according to claim 1, further comprising one or more protrusions positioned within the cavity.

6. A golf club head according to claim 1, wherein the filler engages the face plate.

7. A golf club head according to claim 1, wherein the filler defines an edge of the holes defined by the score lines.

8. A golf club head according to claim 1, wherein the filler is visible though the holes defined by the score lines.

9. A golf club head according to claim 1, wherein the filler comprises, at least in part, one of: resin, rubber, plastic, composite materials, polymer materials, metal, alloy and gel.

10. A golf club head according to claim 1, wherein the filler has a thickness in the range of 1.0-4.0 mm.

11. A golf club head according to claim 1, further comprising a barrier configured to be engaged with the iron type golf club head body and positioned between the face plate and the filler.

12. A golf club head according to claim 11, wherein the barrier separates the face plate from the filler.

13. A golf club head according to claim 11, wherein the barrier has a thickness in the range of 0.1-0.2 mm.

14. A golf club head according to claim 11, wherein the barrier comprises, at least in part, one of: rubber, plastic, composite materials, polymer materials, metal and alloy.

15. A golf club head comprising:

an iron-type golf club head body;

a face plate having a front side and a rear side opposite the front side;

a filler positioned behind the face plate;

a cavity formed on a front surface of the golf club head body and located behind the face plate, wherein the filler is received in the cavity; and a recess formed on the front surface of the golf club head body in communication with and extending beyond the cavity, wherein the face plate is received in the recess to cover the cavity and the filler;

wherein the face plate includes:

a first surface configured to face away from the iron-type golf club head body and contact a golf ball during use;

a second surface, opposite the first surface, configured to face and engage with the iron-type golf club head body; and a plurality of score lines which define holes, and wherein the filler is positioned entirely behind the rear side of the face plate, such that the holes remain void of any material; and wherein the cavity and the filler extend continuously behind all of the plurality of score lines.

16. A golf club head according to claim 15, wherein a thickness of the face plate varies and the second surface defines one or more thicker regions of the faceplate.

17. A golf club head according to claim 16, wherein each of the thicker regions of the faceplate are positioned behind a corresponding score line of the plurality of score lines.

18. A golf club head according to claim 16, wherein the second surface of the face plate defines an undulating or sinusoidal wave pattern.

19. A golf club comprising:

a golf club head, including:

an iron-type golf club head body;

a face plate having a front side and a rear side opposite the front side;

a filler positioned entirely behind the face plate;

a cavity formed on a front surface of the golf club head body and located behind the face plate, wherein the filler is received in the cavity; and a recess formed on the front surface of the golf club head body in communication with and extending beyond the cavity, wherein the face plate is received in the recess to cover the cavity and the filler; and a shaft engaged with the golf club head, wherein the face plate includes a plurality of score lines which define holes that extend through the thickness of the face plate, and wherein the filler is positioned entirely behind the rear side of the face plate, such that the holes remain void of any material; and wherein the cavity and the filler extend continuously behind all of the holes.

20. The golf club according to claim 18, wherein the filler engages the face plate and defines an edge of the holes defined by the score lines, and wherein the filler comprises, at least on part, one of: resin, rubber, plastic, composite materials, polymer materials, metal, alloy and gel.

21. The golf club according to claim 1, wherein the cavity is one continuous cavity and the filler is one continuous filler.

22. The golf club according to claim 15, wherein the cavity is one continuous cavity and the filler is one continuous filler.

* * * * *